United States Patent [19]

Zlevor

[11] 4,264,790

[45] Apr. 28, 1981

[54] DIRECTIONAL MICROPHONE

[75] Inventor: Alfred Zlevor, Vienna, Austria

[73] Assignee: AKG Akustische u.Kino-Geräte Gesellschaft m.b.H., Austria

[21] Appl. No.: 95,999

[22] Filed: Nov. 20, 1979

[30] Foreign Application Priority Data

Nov. 23, 1978 [AT] Austria ..... 8375/78

[51] Int. Cl.[3] ..... H04R 1/20

[52] U.S. Cl. ..... 179/121 D; 179/1 DM; 179/1 MF

[58] Field of Search ..... 179/1 MF, 1 DM, 121 D; 181/175, 176

[56] References Cited

U.S. PATENT DOCUMENTS

| | | | |
|---|---|---|---|
| 2,228,886 | 1/1941 | Olson | 179/1 DM |
| 3,305,043 | 2/1967 | Pfund et al. | 179/1 MF |

FOREIGN PATENT DOCUMENTS

| | | | |
|---|---|---|---|
| 364275 | 10/1938 | Italy | 181/175 |

*Primary Examiner*—George G. Stellar

*Attorney, Agent, or Firm*—McGlew and Tuttle

[57] ABSTRACT

A directional microphone of the interference type comprising a single elongated tube having one or more longitudinal slots or side apertures therein, at least one electroacoustic transducer provided at one end of the tube and an acoustic reflector assembly provided at an opposite free end zone of the tube, by which, preferably, sound waves of the upper audio frequency range are concentrated toward the sound inlet of the interference tube at the opposite free end zone thereof. A directional microphone which is easy to handle and unites the advantages of an interference microphone with that of a reflector microphone is thus obtained.

13 Claims, 6 Drawing Figures

DIRECTIONAL MICROPHONE

FIELD AND BACKGROUND OF THE INVENTION

The present invention relates in general to directional microphones and, in particular to a new and useful directional microphone of the interference and reflector type having a single elongated tube with apertures therethrough with a transducer at one side thereof and a reflector connected to the opposite side thereof.

The principal drawback of prior art constructions for directional microphones of the interference type is that at higher frequencies, the transmission factor is worse than at all the other frequencies. The deterioration at high frequencies is particularly due to the absorbtion of these frequencies on the inside of the tube wall, mainly at locations where acoustic frictional resistances are provided. In addition, the load of the air column in the tube on the transducer diaphragm increases the transmission factor in the mid-frequency range, whereby the impression of an unsatisfactory transmission of the high frequencies is amplified.

To remedy these drawbacks, the attempt has been made to replace the single tube by a tube bundle where the tubes have different lengths. With a careful acoustic tuning of the individual tubes of the bundle, an improvement is in fact obtained, however, such a bundle, of course, is less easy to handle than a single tube, aside from the rather difficult tuning of the individual tubes of the bundle.

Microphones, such as interference microphones, with a sharply beamed directional characteristic, include directional microphones which are equipped with a reflector that mostly corresponds in shape to a parabolic mirror. The microphone of this type is placed at the focus of the parabolic reflector. With such microphones, requirements must be met making a reduction to practice this type of microphone difficult.

To obtain an effective concentration of low frequencies, a reflector of large and unhandy dimensions is needed, since in principle, the diameter of the reflector should at least be equal to the wavelength of the lower-limit frequency to be transmitted. Because such microphones are used primarily outdoors, their construction must be extraordinarily stable to stand transportation and weather conditions. Insufficient stability substantially impairs the directional effect and the sensitivity of these devices.

SUMMARY OF THE INVENTION

The present invention is directed to a directional microphone which is easy to handle and combines the advantages of an interference microphone with those of a reflector microphone. This is obtained with a directional microphone of the above mentioned kind, by providing a single elongated tube having at least one aperture therethrough with at least one electroacoustic transducer at one end of the tube to form an interference type portion of the directional microphone and a concave reflector connected to an opposite end of the tube. Since the reflector assembly is intended, preferably, for correcting losses in high frequencies only, its size can be relatively small. This assembly hardly increases the space and weight needed for the interference microphone above. Due to the small dimensions, the stability of the entire assembly is very satisfactory.

The simplest embodiment of the invention provides the cup shaped or concave reflector having a central opening at its base which is substantially of the same diameter as the interference tube with the reflector at its open base being connected directly to the free end portion of the tube opposite the end carrying the transducer.

In a preferred embodiment of the invention, at the opening corresponding to the diameter of the tube, the reflector carries a sleeve embracing the interference tube and being either fixed to the tube or displaceable thereon. In the last-mentioned design, of course, a means for fixing the sleeve to the tube must be provided, for example, one or more clamping screws. Instead of such screws, the handling of which may be uneasy and time consuming, a bayonet catch may also be provided, of the type used in photo cameras with interchangeable objectives.

Usually, the reflector which is mounted in the zone of the free end of the tube has at least approximately the shape of a parabolic mirror, with the speech or sound inlet of the interference tube extending approximately in a plane passing through the focal point of the reflector. It is not absolutely necessary for the reflector to have a fully developed parabolic shape. Since the central portion in any case contributes little or does not contribute at all to the concentration of sound waves, the reflector may be designed as an annular segment of a paraboloid, so that the opening of the reflector which, in the above described embodiment, has a diameter substantially equal to the outer diameter of the interference tube becomes substantially larger and allows the sound waves to unobstructedly penetrate to the longitudinal slots of the interference tube. In this design, of course, supporting elements are needed by which the reflector is connected to the end portion of the interference tube. Suitable supporting elements are strips of material which substantially extend in planes passing through the tube axis.

If it is desired not to have a lobar space pattern, but to have a directional characteristic which, for example, in a section perpendicular to the main receiving direction has an elliptic instead of circular shape, the inventive design may be modified to give a corresponding shape to the reflector, namely curvatures which are different, but preferably symmetrical, in two planes passing through principal axes.

In a development of the invention, the reflector assembly comprises two reflecting parts, namely a reflector designed in accordance with the above described emdodiments and having its reflecting surface turned to the source of sound, and another, smaller reflector having its reflecting surface turned to the speech or sound inlet of the interference tube. An analogous arrangement is known in light engineering under the designation of "Schmidt optics". It is being employed in devices for large image projections of television pictures. In acoustics, a corresponding arrangement, particularly in connection with directional microphones on the interference principle, has not been used as of yet. The second, smaller reflector, which is coaxial with the larger reflector and the interference tube, reflects the sound waves collected by the large reflector into the speech or sound inlet of the tube, whereby the efficiency is substantially improved as compared to embodiments with a single reflector.

All of the embodiments have the feature in common that the reflector assembly is either mechanically united with the interference tube or forms a separate unit which can be engaged on or removed from the interference tube, as needed.

A further object of the invention is therefore to provide a directional microphone which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

Details of the invention may be learned from the following description of the drawing in which.

DESCRIPTION OF THE PREFERRED EMBODIMENTS

Figure 1:
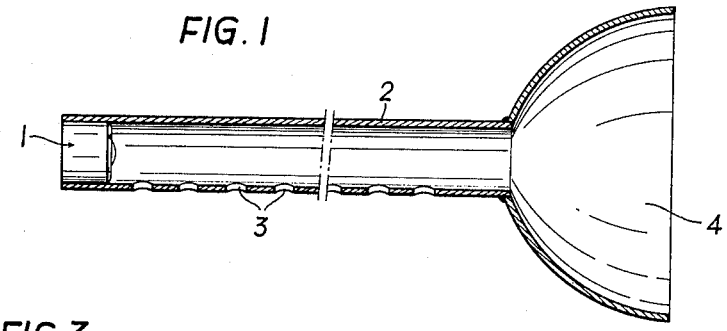
FIG. 1 is a diagrammatical sectional view of a simple embodiment of the invention.

In order to improve the transmission factor in the high frequency range of an interference microphone comprising a single tube, the simplest embodiment of the invention shown in FIG. 1, provides a cup-shaped or concave reflector 4 disposed at that opening of an interference tube 2 which is opposite to the opening accommodating a transducer 1.

To obtain the desired phase shift for developing a strongly beamed directional characteristic, the side apertures 3 of the interference tube are covered with a suitable acoustic frictional material, and/or a side slot is provided, the width of which varies in wedge-like fashion along the tube length.

Figure 2:
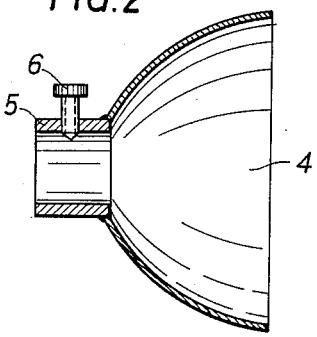
FIG. 2 is a similar view of a reflector with sleeve.

In some instances, for example for transportation, it is desirable to remove the reflector from the interference tube. The design for this purpose is relatively simple and shown in FIG. 2. The opening of reflector 4 into which, in the embodiment of FIG. 1, the interference tube is inserted, is provided with a sleeve 5 which can be snugly engaged over the interference tube. By means of a screw 6 passed through the wall of sleeve 5, reflector 4 can be fixed to tube 2 in any desired position.

Figure 3:
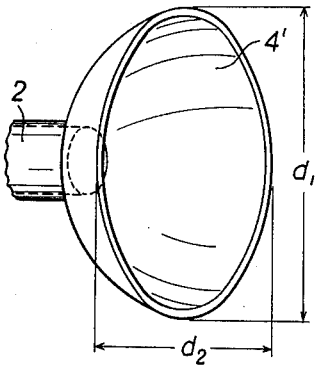
FIG. 3 is a partial perspective view which shows a reflector whose shape differs from that of a parabolic surface.

FIG. 3 shows a reflector 4' having an elliptical, not circular, outer contour. This results in two principal axes $d_1d_2$ which are perpendicular to each other, with which the tube axis forms planes in which reflector 4' is curved differently, but symmetrically, in this embodiment.

Figure 5:
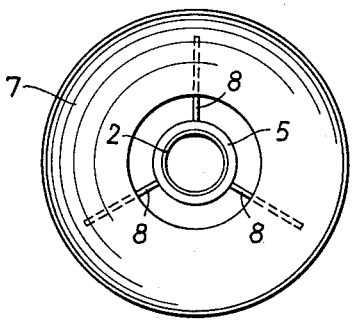
FIG. 5 is a front view corresponding to FIG. 4.
Figure 4:
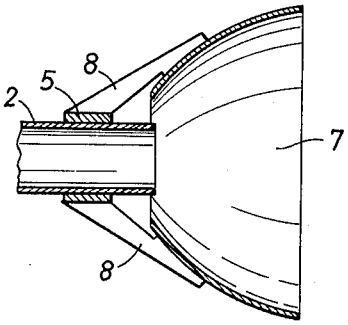
FIG. 4 is a diagrammatical sectional view of an assembly with an annular reflector.

In the embodiment of FIG. 4, reflector 7 is formed of a parabolic annular zone or area, so that the opening which, in the above embodiments, corresponded to the diameter of tube 2, is substantially larger. Reflector 7 is carried, for example, by three bracing elements 8 which extend from sleeve 5. In order not to hinder sound waves from penetrating to slots 3 of interference tube 2, bracing elements 8 are designed as strips having their narrow faces located in planes passing through the tube axis. This may particularly clearly be seen in FIG. 5 which is a front view of the embodiment shown in FIG. 4.

Figure 6:
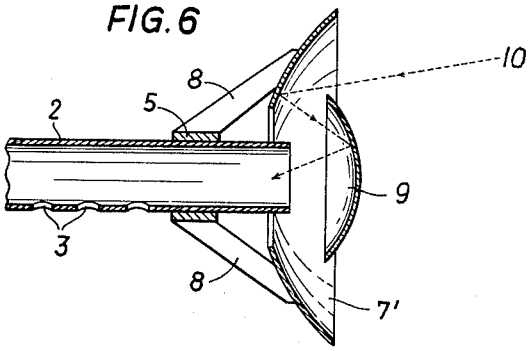
FIG. 6 is a diagrammatical sectional view showing an embodiment of the invention with an assembly comprising two reflectors.

A particularly effective reflector assembly is diagrammatically shown in FIG. 6 in a sectional view. In this embodiment, aside from an annular reflector 7' such as employed in the embodiment of FIG. 4, a second, smaller reflector 9 that is concave toward the sound inlet end of tube 2 is provided by which the sound waves of the high frequency range collected by the reflector 7' are intercepted and deflected directly into the inlet of interference tube 2. The path of the sound waves is diagrammatically indicated by dashed line 10. It is evident that in this embodiment, the portion of sound waves collected by reflector 7' and capable of entering the inlet of interference tube 2 is decidedly larger than in embodiments comprising a single reflector. As in the other embodiments, in this embodiment again, the reflector assembly may be connected to the interference tube fixedly or detachably.

While specific embodiments of the invention have been shown and described in detail to illustrate the application of the principles of the invention, it will be understood that the invention may be embodied otherwise without departing from such principles.

What is claimed is:

1. A directional microphone comprising a single elongated interference tube having at least one aperture in the side thereof and two ends, at least one electroacoustic transducer connected in one end of said tube, and a concave acoustic reflector connected to the opposite end of said tube whereby sound waves of the upper audio frequency range are concentrated and directed into the opposite end of the tube.

2. A directional microphone according to claim 1, wherein said reflector is cup-shaped and has a central opening in the base thereof of a diameter substantially equal to that of said opposite end of said interference tube, said cup-shaped reflector being connected to said interference tube in the vicinity of said operating end at its base.

3. A directional microphone according to claim 2, wherein said reflector further includes a sleeve member extending from the base thereof, said sleeve member disposed over said interference tube in the vicinity of said opposite end and affixed thereto at a selected position on said interference tube.

4. A directional microphone according to claim 1, wherein said reflector is parabolically shaped.

5. A directional microphone according to claim 1, wherein said reflector has a different curved shape symmetrical about at least two intersecting planes passing through a principal apex of said elongated interference tube of different radaii of curvature.

6. A directional microphone according to claim 1, wherein said reflector has a central opening of a diameter larger than that of said interference tube in the vicinity of said opposite end, and at least one bracing element connected between said reflector and said interference tube in the vicinity of said opposite end.

7. A directional microphone according to claim 6 further including a sleeve provided over said interference tube in the vicinity of said opposite end connected to said brace, said sleeve positionable at a selected position on said intermediate tube in the vicinity of said opposite end and affixed thereto.

8. A directional microphone according to claim 6, wherein said reflector is in the shape of an annular section of a parabolic surface.

9. A directional microphone according to claim 6, wherein said reflector is of an oval shape symmetrical in curvature about two different intersecting planes passing through a principal axis of said elongated interference tube.

10. A directional microphone according to claim 1, further including a second smaller reflector than said first mentioned reflector concave toward said opposite end of said interference tube disposed concentric with said first mentioned reflector and interference tube whereby sound waves are first collected by said first mentioned reflector and deflected by said smaller reflector into said opposite end of said interference tube.

11. A directional microphone according to claim 1, wherein said reflector is detachably connected to said interference tube.

12. A directional microphone according to claim 1, wherein said reflector forms an integral part of said interference tube.

13. A directional microphone according to claim 4, wherein said parabolically shaped reflector is positioned so that its focus is in the plane of said opposite end of said interference tube.

* * * * *